US005708720A

United States Patent [19]

Meyer

[11] Patent Number: 5,708,720

[45] Date of Patent: Jan. 13, 1998

[54] HEARING AID TO BE WORN AT THE HEAD

[75] Inventor: Wolfram Meyer, Moehrendorf, Germany

[73] Assignee: Siemens Audiologische Technik GmbH, Erlangen, Germany

[21] Appl. No.: 742,556

[22] Filed: Oct. 28, 1996

Related U.S. Application Data

[63] Continuation of Ser. No. 352,191, Dec. 1, 1994, abandoned.

[30] Foreign Application Priority Data

Dec. 21, 1993 [DE] Germany ..... 43 43 702.8

[51] Int. Cl.[6] ..... H04R 25/00

[52] U.S. Cl. ..... 381/69; 381/68.6; 381/68.7; 174/35 R

[58] Field of Search ..... 381/68, 68.1, 68.5, 381/68.6, 68.7, 69, 69.1, 69.2, 68.3, 68.2, 68.4; 174/35 R, 35 MS; 361/816, 818; 455/89, 90, 300

[56] References Cited

U.S. PATENT DOCUMENTS

| | | | |
|---|---|---|---|
| 2,327,320 | 8/1943 | Shapiro | 381/69.1 |
| 3,736,517 | 5/1973 | Lim | 333/28 R |
| 4,956,868 | 9/1990 | Carlson | 381/199 |
| 4,965,831 | 10/1990 | Schmid | 381/68.7 |
| 4,993,072 | 2/1991 | Murphy . | |
| 5,008,058 | 4/1991 | Henneberger et al. . | |
| 5,008,485 | 4/1991 | Kitagawa . | |
| 5,265,168 | 11/1993 | Schiess et al. | 381/68.7 |
| 5,353,200 | 10/1994 | Bodin et al. | 361/816 |
| 5,640,457 | 6/1997 | Gnecco et al. | 381/69 |

FOREIGN PATENT DOCUMENTS

| | | |
|---|---|---|
| 0 352 954 | 1/1990 | European Pat. Off. . |
| 0 403 112 | 5/1990 | European Pat. Off. . |
| 31 01 519 | 10/1982 | Germany . |
| G 87 13 089 U | 3/1989 | Germany . |
| 39 30 377 | 3/1990 | Germany . |
| 664 057 | 1/1988 | Switzerland . |
| 2 070 890 | 9/1981 | United Kingdom . |

OTHER PUBLICATIONS

"Interference to Hearing Aids by the New Digital Mobile Telephone System, Global System for Mobile (GSM) Communications Standard," Joyner et al., National Acoustic Laboratories, Mar. 30, 1993.

"Interference Problems with GSM Telephones and How to Solve Them," Dalsgaard, Oticontact Newsletter, No. 13, Oct., 1993, p. 2.

Anti–EMI Products Catalog of Würth Electronik Verbindungstechnik GmbH and Co., KG, pp. 38–40.

"Foundations of Wireless," Fourth Ed., Scroggie, Sep., 1943, pp. 175–177 and 182–183.

"FM 2000 FM–Stereo–Tuner der Spitzenklasse," Reeisen, Elektor, No. 253, Jan. 1992, p. 9.

"EHIMA GSM Project Development Phase Project Report," Oct., 1993.

*Primary Examiner*—Huyen D. Le

*Attorney, Agent, or Firm*—Hill, Steadman & Simpson

[57] ABSTRACT

In order to improve the immunity of a hearing aid to interference caused by the penetration of high-frequency electromagnetic waves via seams and openings of the hearing aid housing, the housing is composed of at least two electrically conductive parts that are joined in electrically conductive fashion via a high-frequency seal.

12 Claims, 4 Drawing Sheets

HEARING AID TO BE WORN AT THE HEAD

This is a continuation of application Ser. No. 08/352,191, filed Dec. 01, 1994,abandoned.

BACKGROUND OF THE INVENTION

1. Field of the Invention

The present invention is directed to a hearing aid to be worn at the head, of the type having a housing containing an amplifier circuit, the amplifier circuit including a microphone, an earphone and a battery.

2. Description of the Prior Art

Swiss Patent 664 057 discloses a hearing aid to be worn at the head having a housing wherein an amplifier circuit is arranged. The amplifier circuit has a microphone, an ear phone and a battery. Receptacle parts composed of a metallic or non-metallic material for the electromagnetic shielding of the acoustic transducer are also provided in this hearing aid.

Further, German utility model GM 87 13 089 and European Application 0 352 954 respectively disclose hearing aids having a shielding plate for protecting the ear phone from the magnetic field of an audio coil, and a shielded magnet arrangement for the hearing aid.

Hearing aids of this type can be taken by the hearing-impaired wearer of the hearing aid into the proximity of strong transmitters such as, for example, automobile telephones, mobile radio equipment or microwave irradiation devices. In the proximity of such a transmitter, the emitted electromagnetic waves often have an extremely high field strength. These high-frequency electromagnetic waves can, in particular, penetrate through openings into the hearing aid and may have a disturbing influence on the amplifier circuit.

SUMMARY OF THE INVENTION

An object of the present invention is to provide a hearing aid of the type described above wherein the penetration of high-frequency electromagnetic waves through joints and openings is substantially suppressed.

The above object is achieved in accordance with the principles of the present invention in a hearing aid having a housing formed by at least two electrically conductive housing parts that are connectable in electrically conductive fashion via a high-frequency seal. As a result, joints and openings between the housing parts are closed or shielded in a high-frequency-tight manner by means of the high-frequency seal. Given the inventive fashioning of the hearing aid, high-frequency electromagnetic waves can no longer disturbingly influence the amplifier circuit of the hearing aid or, can only do so to a slight extent. Moreover, the high-frequency seal simultaneously forms a protection against the penetration of superfine foreign bodies such as, for example, dust and/or moisture or sweat into the component mounting space within the hearing aid.

DESCRIPTION OF THE PREFERRED EMBODIMENTS

Figure 1:
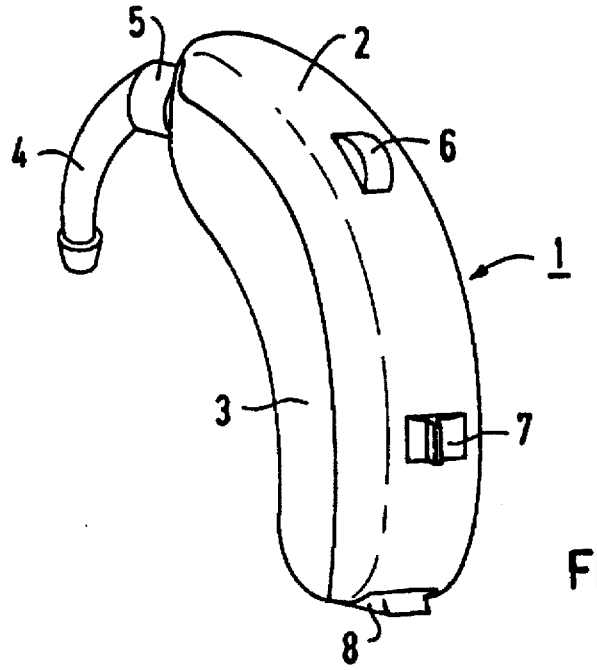
FIG. 1 shows a hearing aid constructed in accordance with the principles of the present invention, to be worn at the head behind the ear, or to be worn contained in the frame of a pair of eyeglasses.

FIG. 1 shows a hearing aid to be worn at the head (behind-the-ear hearing aid) having a hearing aid housing 1 formed by an upper housing shell 2 and a lower housing shell 3. A carrying hook 4 that simultaneously serves as the audio channel is secured to an ear phone output baffle 5 of the housing. An operating element 6, for example, a volume control or potentiometer rotatory knob, a switch 7 and a tab 8 for the battery compartment project from the upper housing shell 2.

Figure 2:
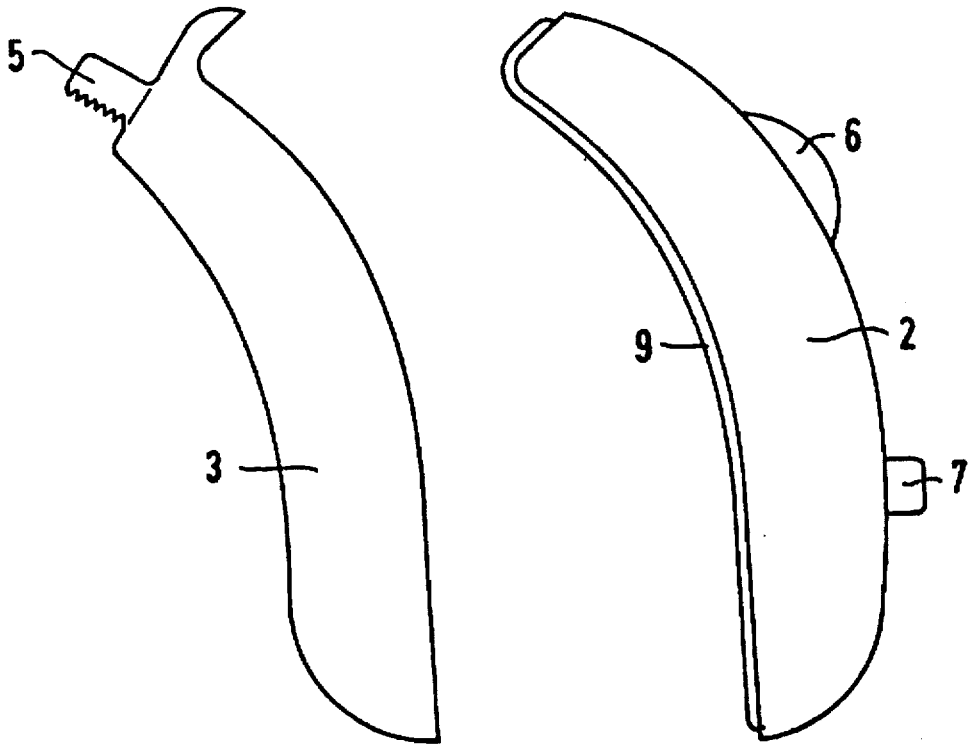
FIG. 2 illustrates the two housing shells of the hearing aid of FIG. 1.
Figure 3:
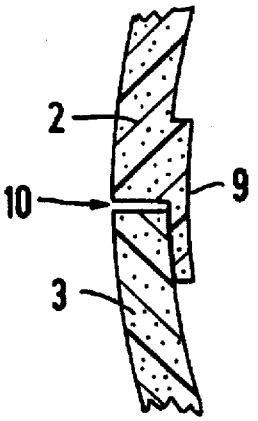
FIGS. 3–5 respectively shown sections through two electrically conductive hearing aid housing parts that adjoin one another in electrically conductive fashion via a separate high-frequency seal.

The two housing shells 2 and 3 are separately shown in FIG. 2. A tongue 9 runs around the inside of the opening of the upper housing shell 2. This tongue 9 covers a small gap 10 (separating seam), as shown in FIG. 3. The gap 10 arises when joining the two housing shells 2 and 3 between seating points that arise due to slight irregularities of the housing shells adjoining one another. According to the invention, the two housing shells 2 and 3 are fashioned as electrically conductive parts. The tongue 9 proceeding around, for example, the upper housing shell 2 is likewise fashioned electrically conductive and is formed as one piece with the upper housing shell 2. The electrically conductive parts 2, 9 and 3 of the housing 1 can, for example, be composed of plastic that has been made conductive by admixing electrically conductive powder, for example, graphite.

Figure 4:
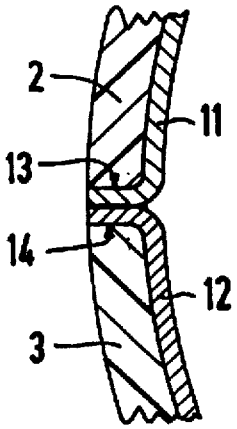

In the embodiment of FIG. 4, the two housing shells 2 and 3 composed of plastic are respectively provided or lined with respective electrically conductive layers 11 and 12, for example, at their inside. The conductive layers 11 and 12 also cover the adjoining edges 13 and 14 of the housing shells 2 and 3. The electrically conductive layers 11 and 12 can be elastically fashioned, so that the gap 10 (separating seam) shown in FIG. 3 can be completely closed when joining the two housing shells 2 and 3 due to the elasticity of the layers 11 and 12 that cover over the edges 13 and 14. The elastic and electrically conductive layers 11 and 12 of the borders 13 and 14 thus form an elastic high-frequency seal. The layers 11 and 12 can be composed of an electrically conductive foil or of an electrically conductive lacquer layer.

Figure 5:
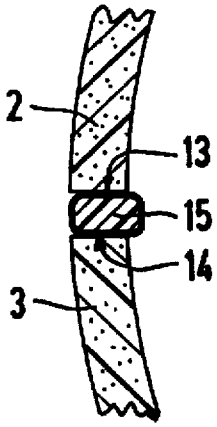

According to FIG. 5, the two housing shells 2 and 3 are again composed of plastic having an embedded, electrically conductive material. According to this exemplary embodiment, an all-around elastic high-frequency seal 15 is arranged between the edges 13 and 14 of the housing shells 2 and 3. For example, this high-frequency seal 15 can be a hose-shaped aluminum foil cladding having an elastic core. Irregularities can thus be compensated high-frequency-tight and a disturbing gap 10 can be avoided or, bridged. Further, the high-frequency seals shown in FIGS. 3–5 can also be provided in combination embodiments.

Figure 6:
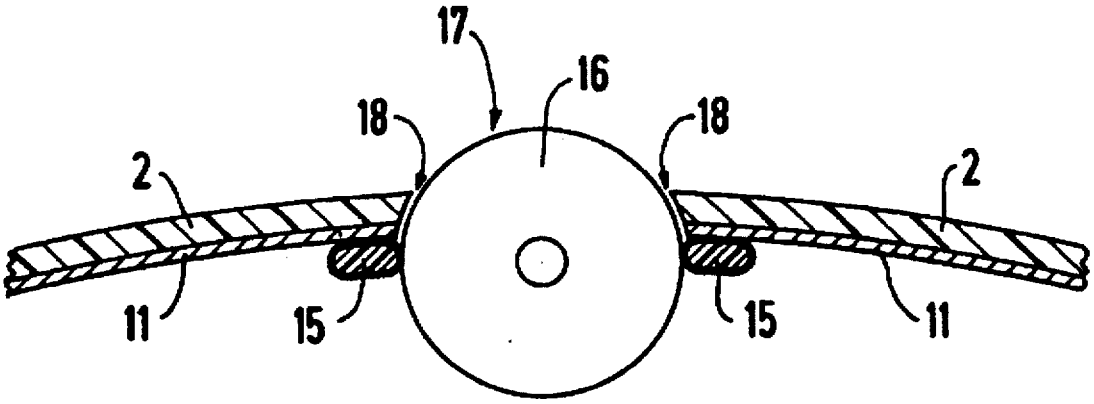
FIG. 6 is a section through an operating element arranged in a housing part having an allocated high-frequency seal.

FIG. 6 shows a portion of the upper housing shell 2 that contains an operating element 16. The operating element 16 is fashioned as an electrically conductive part. The adjoining housing shell 2 has an electrically conductive coat 11, for example, at the inside of the housing. The operating element 16 partially projects from the opening 17 of the housing shell 2, for example, in the form of a small wheel or drum. An annular gap 18 that can be sealed by a high-frequency seal 19 of the above-described type remains between the electrically conductive operating element 16 and the housing shell 2. As a result, the parts 2 and 16 adjoining one another are electrically conductively connected to one another for shielding an external electromagnetic radiation and disturbing housing openings are avoided.

Figure 7:
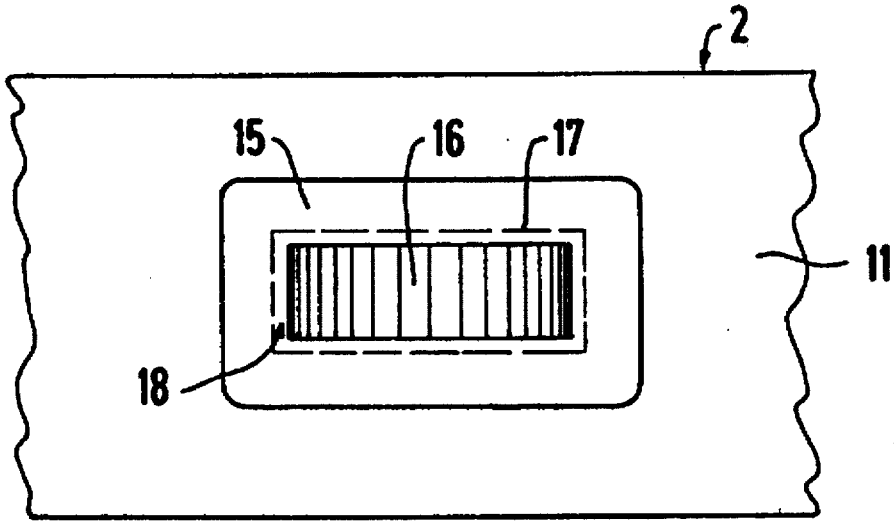
FIG. 7 is a view from the inside of a housing onto an operating element of FIG. 6 provided with a high-frequency seal.

FIG. 7 shows the portion of the upper housing shell shown in FIG. 6 with a direction of view onto the inside of the housing shell (as seen from below onto the coating 11 of the housing). The opening 17 is indicated by a dot-dashed line. The operating element 16 is arranged inside the opening 17. The high-frequency seal 19 closes the gap 18 proceeding around the operating element 16. The operating element 16 can be electrically conductively fashioned in various ways, for example, by manufacturing the small wheel 16 of a plastic that is conductively coated or rendered conductive or metalized.

Figure 8:
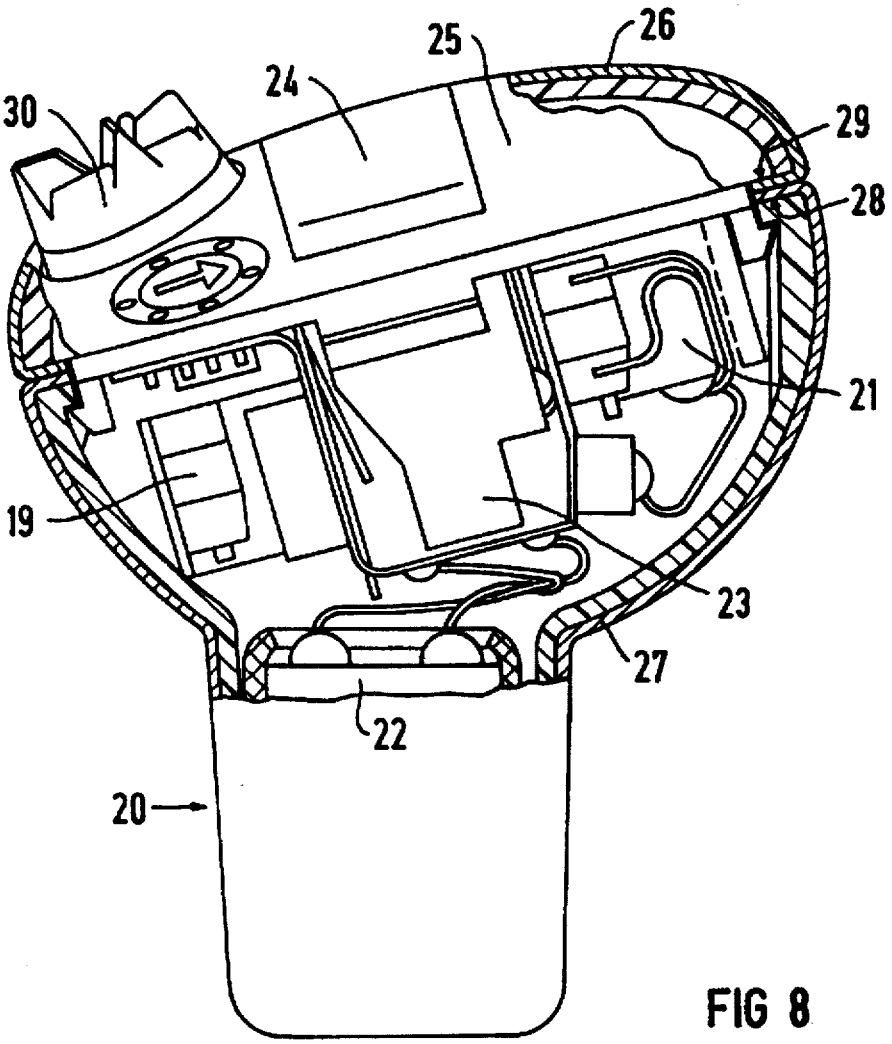
FIG. 8 illustrates a further hearing aid to be worn at the head constructed in accordance with the principles of the present invention that can be introduced into the auditory canal.

In the exemplary embodiment of FIG. 8, the hearing aid to be worn at the head is shown as an in-the-ear hearing aid that has a correspondingly shaped housing 20. An amplifier circuit 19 with various electronic components as well as a microphone 21, an ear phone 22 and a battery introducible into a battery compartment 23 is arranged in the housing 20. The battery can be replaced via a battery holder 24 that can be swung out of a face plate 25. The face plate 25 forms an outer wall of the housing 20 and has an electrically conductive coating 26 for shielding external electromagnetic radiation and for protecting the amplifier circuit 19 against high-frequency electromagnetic waves. Further the housing 20 can carry an electrically conductive coating 27, for example, at its surface. Finally, it is expedient when the allocated seating surfaces 28 and 29 of the in-the-ear hearing aid housing 20, or of the face plate 25, are likewise coated in electrically conductive fashion so as to make an electrically conductive connection, or are sealed from one another and secured by means of an insertable high-frequency seal.

Figure 9:
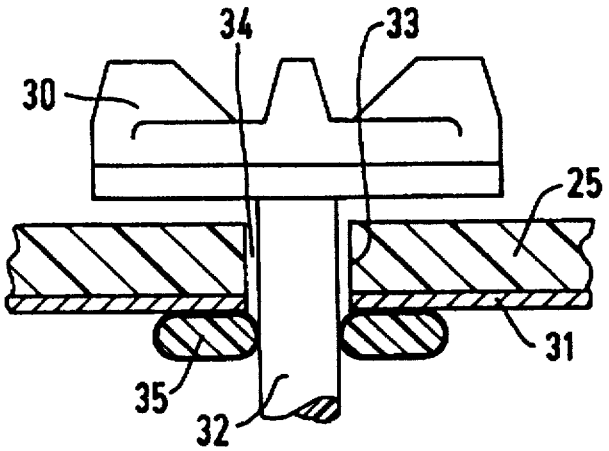
FIG. 9 is a section through a rotatable operating element arranged in a hearing aid housing constructed in accordance with the principles of the present invention and having an allocated high-frequency seal.

FIG. 9 shows the shielded arrangement of the volume control 30 of the in-the-ear hearing aid in the face plate 25 that is provided with an electrically conductive lining 31 at the inside of the housing. The rotational axis 32 of the volume control 30 projects through a bore 33 into the interior of the hearing aid. For sealing and shielding the annular gap 34 between the bore 33 and the rotational axis 32, an annular high-frequency seal 35 having an electrically conductive contact is provided at the lining 31 and surrounding the rotational axis 32.

Further, an electrical connection between the electrically conductive housing lining 31, the high-frequency seal 35 and the amplifier circuit 19 can be produced, for example, by means of the rotational axis 32 of the volume control 30. It is also possible to join the electrically conductive parts of the hearing aid housing by a contact (not shown), for example, to a pole of the battery or a battery spring contact, whereby non-inductive impedance such as capacitors, resistors or the like may be possible provided in the electrical line connection.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing aid comprising:

a housing adapted be worn at the head of a person, said housing containing means for receiving and amplifying audio signals including a microphone, an amplifier circuit, an earphone and a battery connected to said amplifier circuit, said microphone and said earphone; and said housing being comprised of at least two electrically conductive housing parts each having an edge, the respective edges of said housing parts facing each other and means interposed between said edges for mechanically and electrically connecting said electrically conductive housing parts and for forming a high-frequency seal.

2. A hearing aid as claimed in claim 1 wherein said electrically conductive housing parts have a separating seam, and wherein said high-frequency seal comprises an electrically conductive layer placed in said separating seam.

3. A hearing aid as claimed in claim 1 wherein said high frequency seal comprises an elastic high-frequency seal.

4. A hearing aid as claimed in claim 1 wherein said electrically conductive housing parts of said housing each comprise a non-electrically conductive part on which an electrically conductive coating is disposed.

5. A hearing aid as claimed in claim 4 wherein said electrically conductive coating comprises a conductive lacquer, and wherein said high-frequency seal is comprised of a portion of said conductive lacquer.

6. A hearing aid as claimed in claim 1 wherein said high-frequency seal comprises an electrically conductive foil.

7. A hearing aid as claimed in claim 1 wherein said electrically conductive housing parts consist of plastic having an electrically conductive material admixed therein.

8. A hearing aid as claimed in claim 1 wherein said high-frequency seal comprises an elastic core having a metal foil cladding thereon.

9. A hearing aid as claimed in claim 1 wherein one of said electrically conductive housing parts has a tongue projection engaging the other of said electrically conductive housing parts, said tongue consisting of electrically conductive material and forming said high-frequency seal.

10. A hearing aid as claimed in claim 1 further comprising electrically conductive connection connecting said amplifier circuit to at least one of said electrically conducting housing parts at only one location.

11. A hearing aid as claimed in claim 10 wherein said electrically conductive connection of said amplifier circuit to said at least one of said electrically conductive housing parts comprises a pole of said battery.

12. A hearing aid as claimed in claim 10 wherein said electrically conductive connection of said amplifier circuit to said at least one of said electrically conductive housing parts comprises a spring contact for said battery.

* * * * *